United States Patent [19]

Durand

[11] Patent Number: 4,667,825

[45] Date of Patent: May 26, 1987

[54] DISPLAY PACKAGE FOR A GLASS OR SIMILAR ARTICLE

[76] Inventor: Jean-Jacques Durand, La Garenne, 62510 Arques, France

[21] Appl. No.: 837,271

[22] Filed: Mar. 7, 1986

[51] Int. Cl.[4] ..... B65D 5/50; B65D 85/30; B65D 85/44

[52] U.S. Cl. ..... 206/426; 206/45.14; 206/45.17; 206/45.31; 229/164; 229/169

[58] Field of Search ..... 206/45.17, 45.14, 45.31, 206/426, 45.34; 229/164, 165, 169

[56] References Cited

U.S. PATENT DOCUMENTS

| | | | |
|---|---|---|---|
| 2,470,456 | 5/1949 | Bailar et al. | 229/164 |
| 2,784,900 | 3/1957 | Bauer | 229/169 |
| 3,078,028 | 2/1963 | Skawronki | 206/45.19 |
| 3,093,289 | 6/1963 | Reisman | 229/169 |
| 3,185,296 | 5/1965 | Schlage | 206/45.34 |
| 3,987,893 | 10/1976 | Hanson | 206/45.14 |
| 4,470,502 | 9/1984 | Swanberg | 206/45.14 |

FOREIGN PATENT DOCUMENTS

| | | | |
|---|---|---|---|
| 79662 | 11/1962 | France | 229/165 |
| 8202360 | 1/1984 | Netherlands | 206/45.14 |

*Primary Examiner*—William Price
*Assistant Examiner*—Brenda J. Ehrhardt
*Attorney, Agent, or Firm*—Kimmel, Crowell & Weaver

[57] ABSTRACT

A display package for a glass or similar article constructed from a single flat sheet material blank includes a back wall formed from a central rectangular panel of the blank, a pair of reduced height side walls reinforced along their edges formed from two side panels of the blank and two end walls formed by two foldable flaps on the opposite ends of the central rectangular panel and four cooperative retaining tabs carried by the ends of the side panels. A retention tab on one end wall of the package is pushed into the interior of the package to retain a glass therein and a narrow retention flap on the other end wall away from the retention tab is inclined toward the back wall of the display package and extends between the side walls thereof to retain the adjacent end portion of a glass therein. Tabs at the ends of the narrow retention flap are fixed to the side walls of the display package.

5 Claims, 10 Drawing Figures

FIG. 1 PRIOR ART
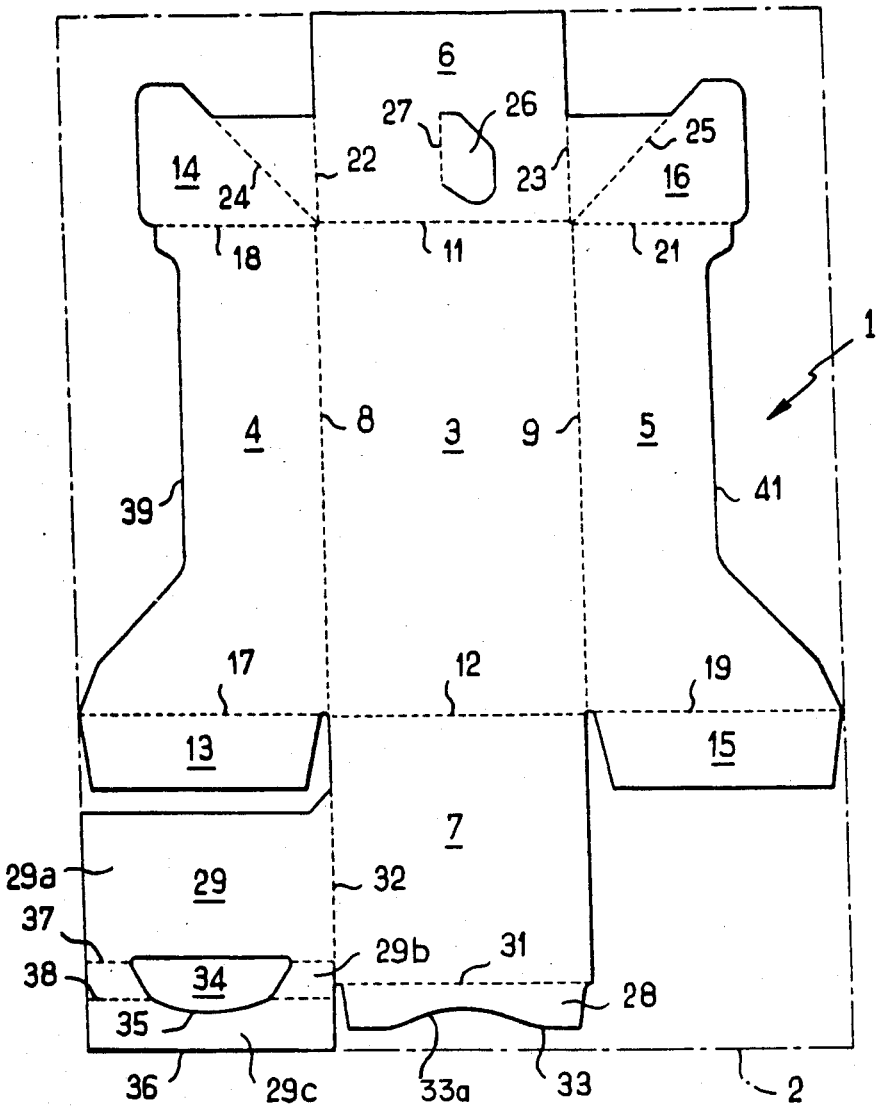
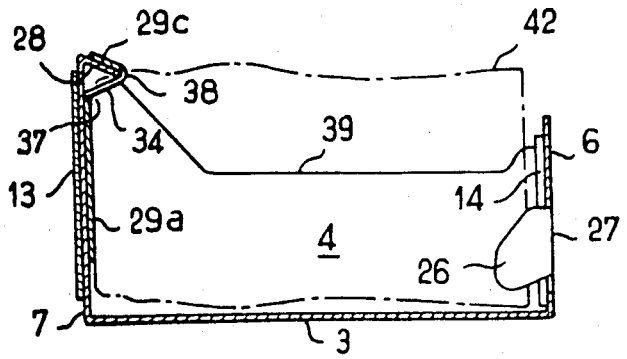
FIG. 2 PRIOR ART 10
20
30
40
3
4
4a
5
5a
6
7
8
9
11
12
13
14
15
16
17
18
19
21
26
27
28
31
33
43
43a
43b
44
44a
44b
45
46
47
48
49
51
51a
52
53
53a
54
55
56

DISPLAY PACKAGE FOR A GLASS OR SIMILAR ARTICLE

BACKGROUND OF THE INVENTION

The present invention relates to a display package for glassware or the like. The display package is constructed from an initially flat single blank of sheet material, such as cardboard, cardboard coated with plastics, or a suitable plastics material. The blank from which the display package is constructed includes a number of fold lines and cuts which enable the easy erection of a simplified unitary display package, by means of known machinery or by hand.

A display package having a general similarity to the present invention is known in the prior art and will be described hereinafter. However, the known package for displaying a glass or the like is considerably more complex in its construction from a sheet material blank, and requires several stages to erect, with the aid of various machines. Since the time required to complete the known display package is greater than the time required to complete the package according to this invention, the prior art package is relatively more expensive. Another drawback of the known package compared to the present invention is that it is made from a blank having considerably more scrap or waste material than the blank utilized for the present invention.

In view of the above, the objective of the present invention is to provide a display package for an article of glassware which is simpler and less expensive both in terms of the time required to complete the package and the relatively smaller amount of raw material required for the blank from which the display package is constructed.

Other features and advantages of the invention will become apparent during the course of the following description.

BRIEF DESCRIPTION OF THE DRAWINGS

FIG. 1 is a plan view of a flat blank used to construct a glassware display package according to the prior art.

FIG. 2 is a longitudinal vertical section taken through a display package constructed from a blank in FIG. 1 according to the prior art.

DETAILED DESCRIPTION

Figures 3, 7:
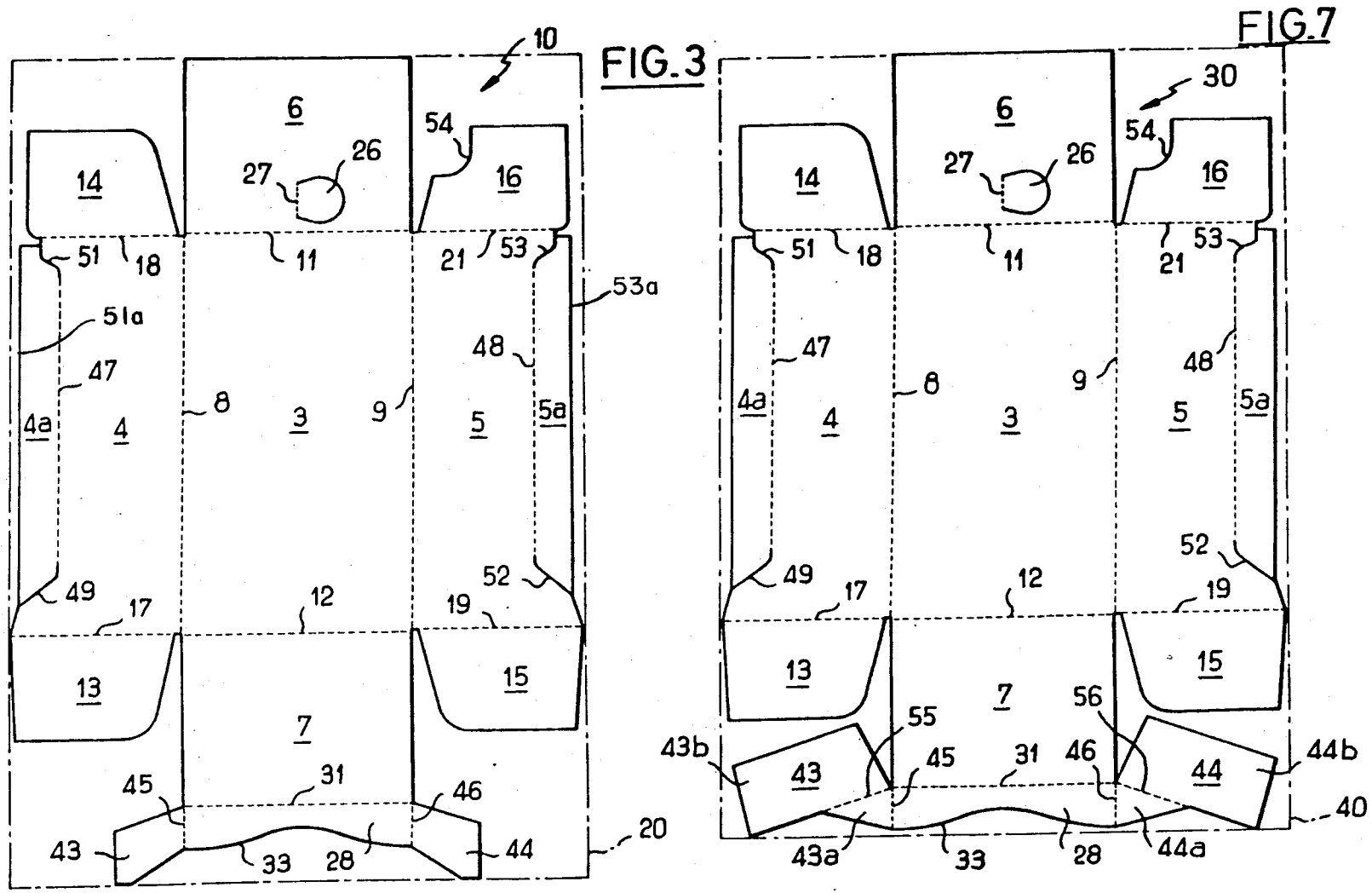
FIG. 3 is a plan view of a blank for use in constructing a display package in accordance with the present invention.
FIG. 7 is a plan view of a modified blank for use in making the display package according to the invention.

Referring to the drawings in detail wherein like numerals designate like parts, a flat blank 1, FIG. 1, according to the prior art, is cut from a rectangular sheet 2 of cardboard, plasticized cardboard or other appropriate sheet material. It can be observed in FIG. 1 that the formation of the blank 1 creates quite a large amount of scrap or waste material in the rectangular sheet 2, and the present invention eliminates a substantial part of this waste of raw material.

The blank 1 comprises a central elongated rectangular panel 3 to become the back wall of the completed display package, two profiled panels 4 and 5 which become the side walls of the display package, and two rectangular end flaps 6 and 7 at the opposite ends of the central panel 3 which form the two end walls of the completed display package.

The panels 4 and 5 are foldable relative to the panel 3 on parallel fold lines 8 and 9 which define the longitudinal edges of the panel 3. The flaps 6 and 7 are similarly foldable on two parallel fold lines 11 and 12 disposed at right angles to the fold lines 8 and 9 and defining the ends of the central panel 3.

The blank 1 further includes retaining tabs 13, 14, 15 and 16 which are joined with the side panels 4 and 5 along fold lines 17, 18, 19 and 21, parallel to the fold lines 11 and 12 and substantially forming extensions thereof. The tabs 14 and 16 are also joined with the end flap 6 on fold lines 22 and 23 at right angles to the lines 18 and 21 and forming substantially extensions of the lines 8 and 9. The tabs 14 and 16 are divided into two parts by additional fold lines 24 and 25 which are disposed at angles of 45° to the fold lines 18 and 21 and diverge away from the adjacent corners of the panel 3 where the lines 8, 9 and 11 intersect. Folding lines 17, 18, 19, 21, 22 and 23 of panels 4 and 5 and flap 6 also serve as fold lines for the two retaining tabs 14 and 16 and the two retaining tabs 13 and 15.

A retaining tab 26 cut centrally in the flap 6 is foldable out of the plane of the flap 6 on a fold line 27 at the center of the flap 6 and panel 3 and being perpendicular to the fold line 11. As shown in FIG. 2, the tab 26 can be pushed into the interior of the display package and into the open mouth of a glass 42 or the like held therein to prevent separation of the glass from the prior art display package. The blank 1 further comprises two additional flaps 28 and 29 which are joined, respectively, to one end and one side of the rectangular flap 7 by perpendicular fold lines 31 and 32. At its midpoint, the flap 33 has a concave arcuate edge **33*a* rendering the flap 28 quite narrow. The flap 29 has a cut-out opening 34 therein having roughly the shape of a trapezoid, of which the shorter base 35 is adjacent to a narrow end flap 36 on the flap 29. The opening 34 has its base or edge 35 curved oppositely to the curved edge 33*a* while the blank 1 is flat. The two curved edges 35 and 33*a* are, however, adapted to register when the flap 29 is folded over onto the flap 7 on the fold line 32. Two fold lines 37 and 38 are provided in the flap 29 parallel to the edge 36, and adjacent to the large and small bases of the trapezoidal opening 34**.

As shown in FIGS. 1 and 2, the exterior longitudinal edges 39 and 41 of panels 4 and 5 are rather deeply recessed into these panels so as to make visible a substantial part of the glass article 42 held in the prior art display package which has a shape somewhat resembling a boat or sled.

The construction of the display package according to the prior art from the flat blank 1 is carried out in the following manner.

In a first phase of construction, panels 4 and 5 and end flap 6 are folded 90° relative to the central panel 3 on fold lines 8, 9 and 11, respectively. The two retaining tabs 14 and 16 are also folded on lines 18, 22 and 24 and 21, 23 and 25, respectively, forming triangles which are glued to the interior face of the folded flap 6 to complete one end wall of the display package.

In a second phase of construction, the flap 28 is first folded on fold line 31 to form substantially a 70° angle with the flap 7. The flap 29 is then folded 180° on the fold line 32 and the part 29*a*, FIG. 1, is glued to the interior face of the flap 7. Following this, the part 29*b* of flap 29 is folded on fold line 37 and part 29*c* is folded on the fold line 38 and glued to the exterior face of the flap 28, as shown in FIG. 2. At this point, the curved edge 35 of opening 34 is in registration with the curved edge 33*a* of flap 28.

The order of the first and second phases of construction described above can be reversed, if desired.

In a third phase of construction, the glass 42 is placed in the display package, which has been partly formed, as described above.

In a fourth phase, the flap 7 is folded 90° on the fold line 12, and the retaining tabs 13 and 15 are folded 90° on fold lines 17 and 19 and are glued against the exterior face of the flap 7. At this point, parts 29*b* and 29*c* of flap 29 and the flap 28 form an edge, FIG. 2, which retains the base of the glass 42 to prevent it from falling out of the display package. The base of the glass 42 is partly received in the opening 34, as shown in FIG. 2.

In a fifth and final phase of construction, retaining tab 26 is pushed into the interior of the package and into the open mouth of the glass 42 near the side wall of the glass to prevent the glass from falling out of the display package.

In the prior art display package, above described, it is to be noted that the placement of the glass 42 in the package (third phase) must take place before folding the flap 7 and fixing the tabs 13 and 15 to the flap 7 (fourth phase). Otherwise, if the fourth phase is undertaken before the third phase, the placement of the glass 42 in the package cannot be accomplished or can only be done with great difficulty because of the presence of the edge formed by the elements 29*b* and 29*c* of the flap 29. Consequently, the prior art display package cannot be completely formed in a single phase by the use of a single machine, but must be formed in the several phases described above with the use of several different machines.

In accordance with the present invention, a more simplified and more economical display package is constructed from a flat blank 10 shown in FIG. 3 of the drawings. The blank 10 is cut from a rectangular sheet 20 of cardboard or the like which can be somewhat shorter and involves considerably less scrap material as is apparent from a comparison of FIGS. 1 and 3. The parts of the blank 10 which are identical to, or which serve the same purpose as those in the blank 1, are designated by the same reference numerals and are not described again in detail. The blank 10 differs essentially from the blank 1 in that it does not have the panel 29. Instead, two tabs 43 and 44 carried by the flap 28 are foldable on two fold lines 45 and 46 aligned with the side edges of the flap 7 and being perpendicular to the fold line 31. Additionally, each of the panels 4 and 5 has a longitudinal fold line 47 and 48, which extends parallel to the lines 8 and 9 along the major length of panels 4 and 5. Two cuts 49 and 51 are formed in the panel 4, each extending from one end of the fold line 47 toward one of the ends of the long exterior edge 51*a*. Similarly, two cuts 52 and 53 are formed in the panel 5 and each cut extends from one end of the fold line 48 toward one end of the exterior longitudinal edge 53*a* of the panel 5. In this manner, two narrow longitudinal package side wall reinforcing flaps 4*a* and 5*a* are produced on the blank.

Retaining tabs 14 and 16 of the blank 10 are joined only to the panels 4 and 5 at the fold lines 18 and 21. The retaining tab 16 has a notch 54 formed therein whose use will be described.

Figure 4:
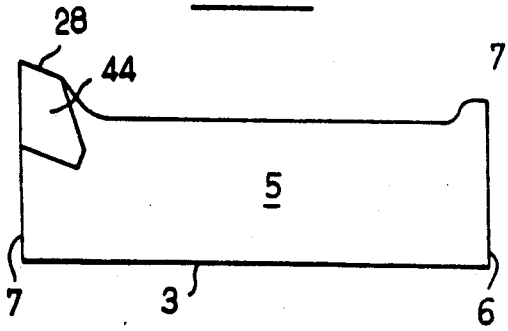
FIG. 4 is a side elevation of the completed display package according to the invention.
Figure 5:
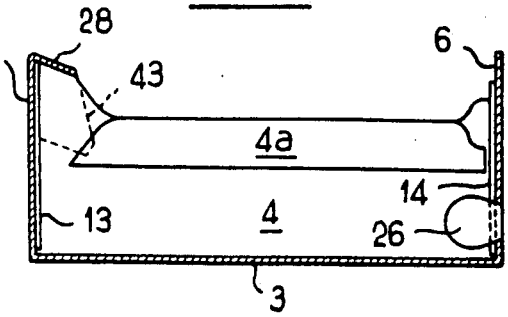
FIG. 5 is a longitudinal vertical section through the display package taken on line V—V of FIG. 6.
Figure 6:
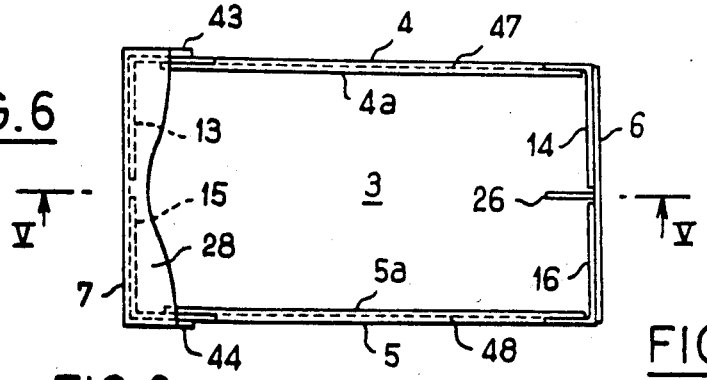
FIG. 6 is a plan view of the display package.

The display package according to the present invention shown in FIGS. 4–6 is completed in the following manner. The panels 4 and 5 and the flaps 6 and 7 are folded 90° relative to the panel 3 on fold lines 8, 9, 11 and 12. Simultaneously, the four retaining tabs 13, 14, 15 and 16 are folded 90° on fold lines 17, 18, 19 and 21, and are fixed to the flaps 6 and 7. During these folding procedures, the retaining tabs 13 and 15 can be placed against either the exterior or the interior face of the flap 7 and the retaining tabs 14 and 16 can similarly be placed against the exterior or interior face of flap 6, as found desirable. The fixing of the tabs 13, 14, 15 and 16 to flaps 6 and 7 can be carried out by gluing or stapling. All of these above operations are carried out in a single phase of construction of the package employing a machine known in the art as a "boat shaper". At the end of this first phase, the display package is substantially completely formed.

In cases where the narrow flaps 4*a* and 5*a* are provided on the blank 10, these flaps 4*a* and 5*a* are folded on their fold lines 47 and 48 toward the interior of the package, and serve to reinforce and make more rigid the display package side walls, FIGS. 5 and 6. Simultaneously, the folding over of the flaps 4*a* and 5*a* forms long indentations at the tops of the package side walls to increase the viewability of the glass article being held therein. The operation of folding the flaps 4*a* and 5*a* can be accomplished without increasing the length of the operation of forming the improved display package and placing the glass article 42 therein. In fact, this folding operation can be carried out during the transfer of the package from the "boat shaper" machine to a counter where the article 42 is placed in the package without stopping the movement of the package on the production line.

Next, in a second phase, the glass 42 or a piece of stemmed glassware is placed in the package. In a third phase, flap 28 is folded on line 31 toward the interior of the package in such a manner as to form an angle of about 70° with the flap 7, FIG. 5. Simultaneously, the two tabs 43 and 44 are folded 90° on fold lines 45 and 46 and are fixed, respectively, to the panels or side walls 4 and 5. Tabs 43 and 44 can be fixed to the exterior faces of panels 4 and 5, FIGS. 4–6, or to their interior faces. The fixation of the tabs 43 and 44 to the panels 4 and 5 can be done by gluing or stapling. When the tabs 43 and 44 are fixed to the panels 4 and 5, flap 28 forms an edge or narrow wall which prevents the tumbler or stemmed glass from falling out of the display package. Next, the retaining tab 26 is pushed into the interior of the package, FIGS. 5 and 6, and enters the mouth of the tumbler in the same manner shown in FIG. 2 to retain the tumbler in the package. The notch 54 of flap 16 allows the retaining tab 26 to be pushed in, once the flap 16 has been fixed to the flap 6. From the foregoing, it is clear that the glassware display package of the present invention obtained from the blank 10 requires fewer construction phases than the prior art display package, FIGS. 1 and 2, since the package according to the invention is essentially formed in a single phase or step by using the commercial "boat shaper" machine. Also, it can be noted that the folding operations of flap 28 and the two tabs 43 and 44 are simpler to execute than the folding operations of flaps 28 and 29 and the parts 29*b* and 29*c* in the prior art blank and package. Therefore, the present invention can employ less complicated tooling.

Moreover, for packages of equal dimensions, the blank 10, FIG. 3, fits into a rectangle 20 of shorter length than the rectangle 2 of FIG. 1. Thus, a significant savings of raw material is enabled by the present invention. This is due to the fact that the length of edge 36 of flap 29, FIG. 1, is equal to the length of the end or folding line 31 of adjacent flap 7.

FIG. 7 shows a modified blank 30 from which the present invention can also be constructed. The elements of the blank 30 which are identical to, or which serve the same purpose, as the corresponding elements of the blank 10 are given the same reference numerals, and will not be described again in detail. The blank 30 differs from the blank 10 in that each of the tabs 43 and 44 have a part 43*a* or 44*a* in the shape of an isosceles triangle, glued to part 43*b* or 44*b* which are in the shape of a trapezoid. The bases of the isosceles triangles 43*a* and 44*a* are formed by the folding lines 45 and 46 at the ends of flap 28, FIG. 7. Folding lines 55 and 56 are provided between corresponding sides of the triangular parts 43*a* and 44*a* and the wide bases of the tabs 43 and 44.

Figure 8:
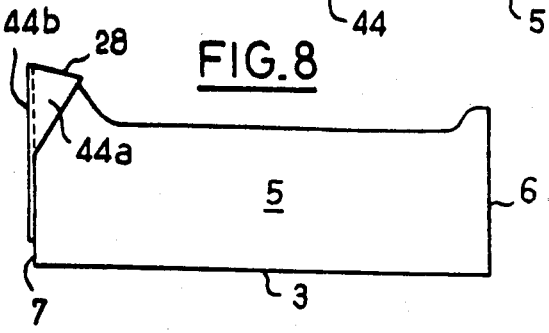
FIG. 8 is a side elevation of the display package construction from the blank in FIG. 7.
Figure 9:
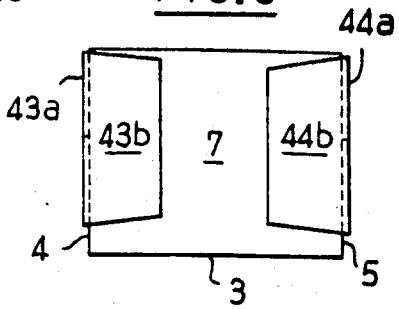
FIG. 9 is an end elevation of the display package shown in FIG. 8.
Figure 10:
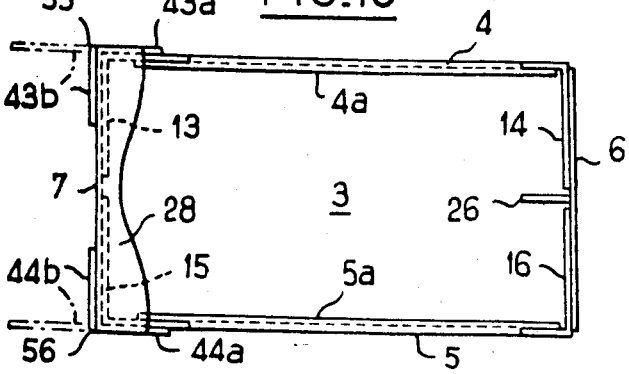
FIG. 10 is a plan view of the package shown in FIGS. 8 and 9.

The display package obtained from the blank 30 and shown in FIGS. 8, 9 and 10 is formed and filled with the glass article in a manner similar to that described in connection with the blank 10 and the article shown in FIGS. 4, 5 and 6. The only difference is that after having folded the flap 28 on the line 31, FIG. 7, and after having folded two tabs 43 and 44 for 90° on the lines 45 and 46 to apply parts 43*a* and 44*a* against the exterior faces of panels 4 and 5, respectively, fold lines 55 and 56 are then lined up with the vertical edges of the package, FIG. 10, situated, respectively, at the corners formed between the flap 7 and the panels or side walls 4 and 5. Parts 43*b* and 44*b* are then folded 90° on fold lines 55 and 56 toward the exterior face of the flap 7, FIGS. 8 and 10, and are fixed to this flap by gluing or stapling. In this form of the invention, the parts 43*a* and 44*a* need not be fixed to the panels 4 and 5, although it is preferable to do so.

Comparing FIGS. 3 and 7 of the drawings will indicate that the blank 30 fits into a rectangle 40 which is shorter than the rectangle 20 containing the blank 10. Thus, the blank 30 allows even a greater savings of material than the blank 10.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A display package for a glass or similar article constructed from a single initially flat blank of sheet material having fold lines and cuts therein, said display package including a back wall formed from a central rectangular panel of the blank, a pair of reduced height side walls formed from two side foldable panels of the blank on opposite sides of said central rectangular panel and two end walls formed by foldable flaps on the opposite ends of the central rectangular panel of the blank and on opposite ends of said two side foldable panels, a first glass retention tab on one end wall of the display package adapted to be pushed into the interior of the package and into the interior of a glass being held in the package, and a second glass retention means on the package adjacent to its other end wall and including a narrow flap on the edge of the other end wall away from said back wall and being inclined toward the back wall at an acute angle to the other end wall, said narrow flap extending between the side walls of the package and having two foldable end tabs thereon which are fixed to the exterior faces of the side walls of the display package to hold said narrow flap inclined toward the back wall so that it can retain one end portion of a glass in said display package.

2. A display package for a glass or similar article as defined in claim 1, and longitudinal relatively narrow stiffening flaps fixed to the interior faces of said side walls and reinforcing the edges of said side walls throughout substantially their full lengths.

3. A display package for a glass or similar article constructed from a single blank of sheet material, said blank comprising a central rectangular panel adapted to form a back wall of the display package, first and second side panels connected to opposite sides of said central rectangular panel and adapted to form two side walls of the display package when folded at right angles to the central panel, a pair of end flaps on the central rectangular panel which are adapted to form two end walls on the display package after being folded at right angles to the central rectangular panel, a first pair of retaining tabs on the ends of the first side panel, a second pair of retaining tabs on the ends of the second side panel, the two pairs of retaining tabs after being folded at right angles to the first and second side panels serving to fix the first and second side panels to the end flaps on the central rectangular panel to thereby form the end walls of the display package, a retaining tab cut from one of said end flaps and adapted to be folded toward the interior of the display package to retain therein one end of a glass or the like contained in the display package, and retention means on the other end of the package to retain the other end portion of a glass or the like in the package, said retention means comprising a narrow retention flap of roughly rectangular form carried by the outer end of the other end flap of the central rectangular panel, said narrow retention flap carrying two end tabs which extend beyond the side edges of said second end flap and which are foldable relative to the second end flap and narrow retention flap on fold lines which coincide with the side edges of the second end flap and which are adapted after being folded 90° relative to the narrow retention flap to be fixed to the exterior faces of said first and second side panels forming the two side walls of the display package.

4. A display package for a glass or similar article constructed from a single blank of sheet material, said blank comprising a central rectangular panel adapted to form a back wall of the display package, first and second side panels connected to opposite sides of said central rectangular panel and adapted to form two side walls on the display package when folded at right angles to the central panel, a pair of end flaps on the central rectangular panel which are adapted to form two end walls on the display package after being folded at right angles to the central rectangular panel, a first pair of retaining tabs on the ends of the first side panel, a second pair of retaining tabs on the ends of the second side panel, the two pairs of retaining tabs after being folded at right angles to the first and second side panels serving to fix the first and second side panels to the end flaps on the central rectangular panel to thereby form the end walls of the display package, a retaining tab cut from one of said end flaps and adapted to be folded toward the interior of the display package to retain therein one end of a glass or the like contained in the display package, retention means comprising a narrow retention flap of roughly rectangular form carried by the outer end of the other end flap of the central rectangular panel, said narrow retention flap carrying two end tabs which extend beyond the side edges of said second end flap and which are foldable relative to the second end flap and narrow retention flap on fold lines which coincide with the side edges of the second end flap and which are adapted after being folded 90° relative to the narrow retention flap to be fixed to said first and second side panels forming the two side walls of the display package, and each of the two end tabs including a part shaped as an isosceles triangle fixed to another part shaped as a trapezoid, the base of each triangular part being connected to one end of said narrow retention flap, there being fold lines between the trapezoidal-shaped parts and the triangular parts at corresponding sides of the triangular parts and at the bases of the trapezoidal parts, whereby the trapezoidal parts after folding on said fold lines can be fixed to the exterior face of the second end flap forming one end wall of the display package.

5. A display package for a glass or similar article as defined in claim 4, and each of said first and second side panels having longitudinal fold lines near their edges away from the central rectangular panel and extending for a major portion of their lengths, each side panel having a pair of cuts at the opposite ends of said fold lines which extend from the ends of the fold lines to the ends of the side panels, and said fold lines and cuts defining on the side panels narrow longitudinal flaps adapted to be folded 180° so as to lie on corresponding faces of the side panels when the latter are forming the opposite side walls of the display package to increase the rigidity of such side walls.

* * * * *